US007815077B2

(12) United States Patent
Yang et al.

(10) Patent No.: US 7,815,077 B2
(45) Date of Patent: Oct. 19, 2010

(54) SOAP DISPENSING APPARATUS

(75) Inventors: Frank Yang, Rancho Palos Verdes, CA (US); Adam C. Wade, Rancho Santa Margarita, CA (US); Joseph Sandor, Santa Ana Heights, CA (US)

(73) Assignee: Simplehuman LLC, Torrance, CA (US)

( * ) Notice: Subject to any disclaimer, the term of this patent is extended or adjusted under 35 U.S.C. 154(b) by 11 days.

(21) Appl. No.: 12/459,575

(22) Filed: Jul. 2, 2009

(65) Prior Publication Data

US 2009/0266848 A1 Oct. 29, 2009

Related U.S. Application Data

(63) Continuation of application No. 11/231,217, filed on Sep. 19, 2005, now Pat. No. 7,556,179.

(51) Int. Cl.
*B65D 88/54* (2006.01)

(52) U.S. Cl. ..... 222/321.8; 222/129; 222/130; 222/321.7; 222/321.9; 222/385; 222/472

(58) Field of Classification Search ..... 222/321.8, 222/482, 483, 402.13, 402.15, 320, 323, 222/324, 385, 472–475, 321.7, 182, 321.9, 222/129–130, 1
See application file for complete search history.

(56) References Cited

U.S. PATENT DOCUMENTS

| | | | | |
|---|---|---|---|---|
| 113,786 | A | 4/1871 | Mumler | |
| 1,466,804 | A * | 9/1923 | Orr | 222/144.5 |
| 2,292,749 | A * | 8/1942 | Feinson et al. | 222/179 |
| 2,563,865 | A | 8/1951 | Pottle | |
| 2,681,622 | A | 6/1954 | Titus | |
| 3,154,224 | A | 10/1964 | Wakeman | |
| 3,814,292 | A | 6/1974 | Dargols | |
| 4,077,549 | A | 3/1978 | Beard | |
| 4,932,563 | A * | 6/1990 | Diamond et al. | 222/129 |
| 5,332,129 | A | 7/1994 | Brattoli et al. | |
| 5,377,869 | A | 1/1995 | Weiss et al. | |
| 5,624,055 | A | 4/1997 | Clanet et al. | |
| 5,806,723 | A * | 9/1998 | DuBose | 222/211 |
| 6,681,956 | B2 * | 1/2004 | Bolgar | 222/129 |
| 6,799,700 | B2 * | 10/2004 | Durant et al. | 222/129 |
| 7,124,915 | B2 | 10/2006 | Restine | |
| 7,216,780 | B2 * | 5/2007 | Durant et al. | 222/129 |
| 7,556,179 | B2 * | 7/2009 | Yang et al. | 222/321.8 |
| 2002/0005412 | A1 * | 1/2002 | Laforcade | 222/129 |
| 2005/0061835 | A1 * | 3/2005 | Kasting et al. | 222/321.8 |
| 2005/0098584 | A1 | 5/2005 | Do Rosario | |

* cited by examiner

*Primary Examiner*—Frederick C. Nicolas
(74) *Attorney, Agent, or Firm*—Raymond Sun

(57) ABSTRACT

A soap dispensing assembly has a container housing having an interior that retains soap. The container housing has an opening which communicates with the interior. A pump unit secured to the top of the container housing at a location separate from the opening. The pump unit includes a dispensing assembly through which soap from the interior is dispensed. A lid that is removably coupled to the opening to allow for a quick replenishment of the soap without having to remove the pump unit. The pump unit can also include an actuator that has a soap outlet, with the actuator is pivoted to draw soap from the interior of the container housing to the soap outlet.

9 Claims, 6 Drawing Sheets

SOAP DISPENSING APPARATUS

RELATED CASES

This is a continuation application of Ser. No. 11/231,217, filed Sep. 19, 2005, now U.S. Pat. No. 7,556,179, whose disclosures are incorporated by this reference as though fully set forth herein.

BACKGROUND OF THE INVENTION

1. Field of the Invention

The present invention relates to a soap dispensing apparatus, and in particular, to a soap dispensing apparatus that is more convenient to use, and which provides a soap container whose supply of soap can be easily replenished.

2. Description of the Prior Art

Soap dispensers are typically provided in the form of a small plastic bottle having a pump unit removably coupled (e.g., by a threaded connection) to the neck of the bottle. The pump unit includes a lid cover that covers the top of the bottle, a pump tubing that extends into the soap bottle, and a handle housing that has a soap outlet through which soap can be pumped. To dispense soap, the user needs to push vertically downwardly on the pump unit. Unfortunately, when the soap supply in the bottle is low, the user is required to exert a significant amount of force to dispense soap.

In addition, when the soap in the bottle has been used up, the pump unit is removed, and new soap added to the bottle. However, this can be messy and inconvenient, because the entire pump unit must be removed to provide access to the mouth of the bottle.

SUMMARY OF THE DISCLOSURE

It is an object of the present invention to provide a soap dispensing apparatus that allows for convenient use, and for convenient replenishment of soap.

In order to accomplish the objects of the present invention, the present invention provides a soap dispensing assembly having a container housing having an interior that retains soap. The container housing has an opening which communicates with the interior. A pump unit secured to the top of the container housing at a location separate from the opening. The pump unit includes a dispensing assembly through which soap from the interior is dispensed. A lid that is removably coupled to the opening to allow for a quick replenishment of the soap without having to remove the pump unit.

In another embodiment of the present invention, the pump unit includes an actuator that has a soap outlet, with the actuator is pivoted to draw soap from the interior of the container housing to the soap outlet.

DETAILED DESCRIPTION OF THE PREFERRED EMBODIMENTS

Figure 1:
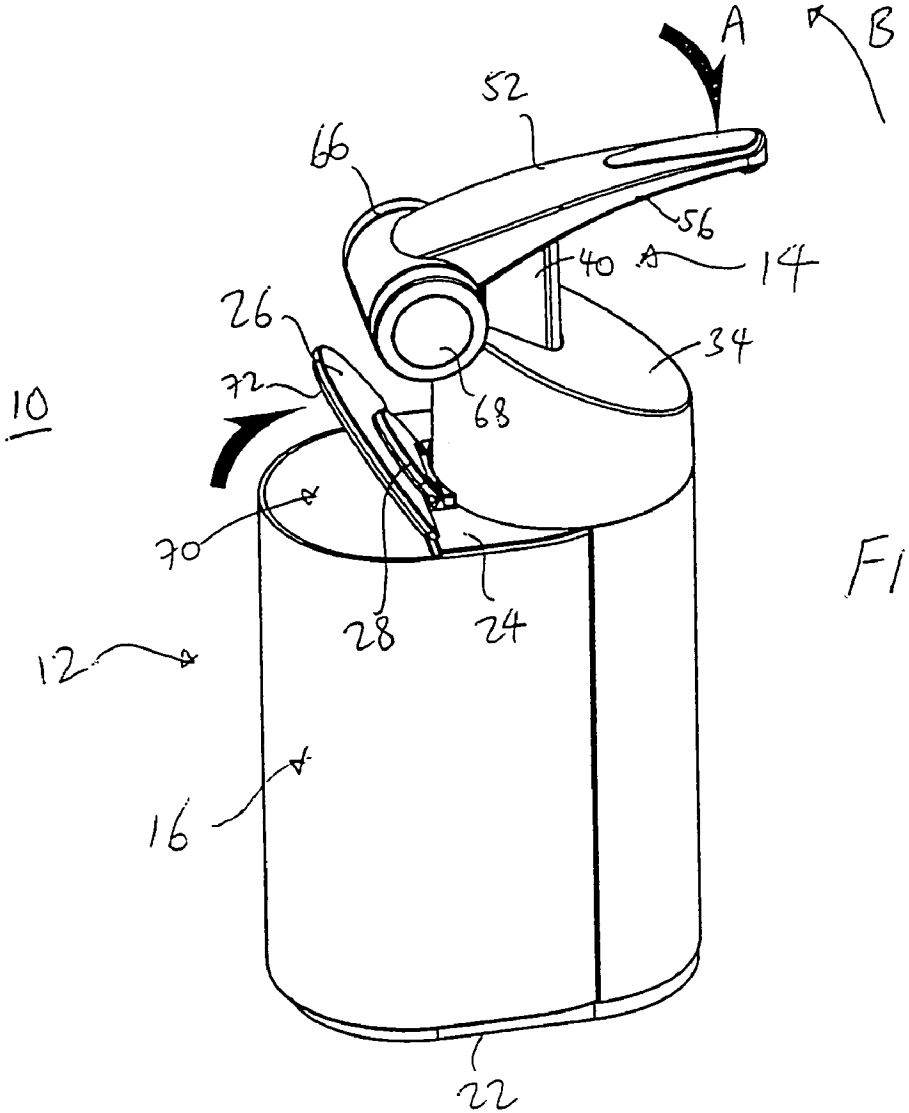
FIG. 1 is a perspective view of a soap dispensing apparatus according to one embodiment of the present invention shown with the lid being partially opened.

The following detailed description is of the best presently contemplated modes of carrying out the invention. This description is not to be taken in a limiting sense, but is made merely for the purpose of illustrating general principles of embodiments of the invention. The scope of the invention is best defined by the appended claims.

FIGS. 1-8 illustrate a soap dispensing apparatus 10 according to one embodiment of the present invention. Referring first to FIGS. 1-4, the apparatus 10 includes a container housing 12 and a pump unit 14. The container housing 12 has an outer wall 16 that can have any desired configuration, including oval, circular, square, rectangular, or a four-sided configuration with two opposing straight walls and two opposing curved walls (as shown in FIGS. 1-4). The outer wall 16 can be translucent so that the user can see the level of the soap inside the container housing 12. The container housing 12 has a front cover portion 18 and a container portion 20 that are connected to each other. A base plate 22 defines the bottom of the container housing 12, and is secured to the bottom of the outer wall 16. A top plate 24 is secured to, and covers, the top of the front cover portion 18 and part of the container portion 20. The pump unit 14 extends through an opening in the top plate 24 at about a central portion thereof. An open top 70 is defined at the top of the container portion 20. A lid 26 is hingedly attached to the rear edge of the top plate 24 by a hinge mechanism 28, to cover the open top 70, and to provide access to the interior of the container portion 20. In this regard, the top plate 24 can extend across the entire top of the container portion 20, with the open top 70 embodied as a smaller opening in the top plate 24.

Referring to FIGS. 3-6, the pump unit 14 includes a dispensing assembly 30, a pump 32, and a pump housing 34. The pump 32 includes an intake tube 36 that extends into the interior 38 of the container portion 20, and can be embodied in the form of any conventional pump 32 that is currently being used for conventional soap dispensers. The intake tube 36 extends through the opening in the top plate 24, and the top of the intake tube 36 extends into, and is secured to, the pump housing 34. The pump housing 34 is secured on top of the top plate 24.

The dispensing assembly 30 includes a support piece 40 that extends from an opening 41 at the top of the pump housing 34. The support piece 40 is adapted to move up and down through the opening 41. The support piece 40 has a lower bore 42 and an upper bore 46 which are separated by a mounting plate 43. A tubular member 45 extends from the bottom of the mounting plate 43 into the lower bore 42 to receive the top end of a connector tube 44. The bottom end of the connector tube 44 is connected to the intake tube 36 (see FIG. 3). A tubular member 47 extends from the top of the mounting plate 43 into the upper bore 46 to receive the bottom end of a tubular rubber connector 48. The rubber connector 48 has a generally L-shaped configuration, with a first leg 49 extending into the upper bore 46 and coupling the tubular member 47, and a second leg 51 extending generally perpendicular to the first leg 49. A soap outlet tube 50 is connected to the front end of the second leg 51 of the rubber connector 48. The soap outlet tube 50 can be made from a different material as the rubber connector 48. A handle housing is pivotally connected to the pump housing 34, and includes an upper handle housing 52 and a lower handle housing 54. The handle housing functions as an actuator for dispensing soap. The upper handle housing 52 and the lower handle housing 54 define an internal space that houses the soap outlet tube 50 and the second leg 51 of the rubber connector 48. An outlet 56 is provided at the front tip of the lower handle housing 54 to receive a hooked front end 58 of the soap outlet tube 50.

A pivot hinge housing 60 extends from the rear of the pump housing 34, and the rear ends of the upper handle housing 52 and the lower handle housing 54 are retained inside the pivot hinge housing 60 in a manner such that a through hole 62 extends through the pivot hinge housing 60, the upper handle housing 52 and the lower handle housing 54. A pivot shaft 64 is carried on a first pivot cap 66, with the first pivot cap 66 positioned on one side of the pivot hinge housing 60 so that the pivot shaft 64 extends through the through hole 62 to form a pivoting connection with the pivot shaft 64 defining a pivot axis. A second pivot cap 68 is provided on the other side of the pivot hinge housing 60 to connect the pivot shaft 64.

Figure 8:
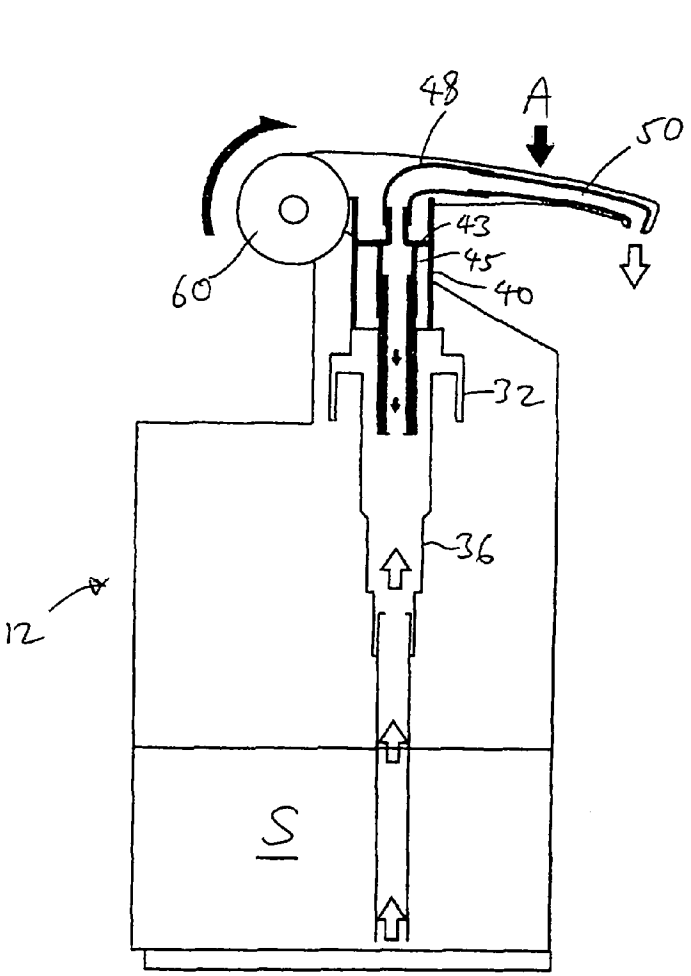
FIG. 8 is a cross-sectional view of part of the pump unit of the apparatus of FIG. 1 with the pump unit shown in use.
Figure 7:
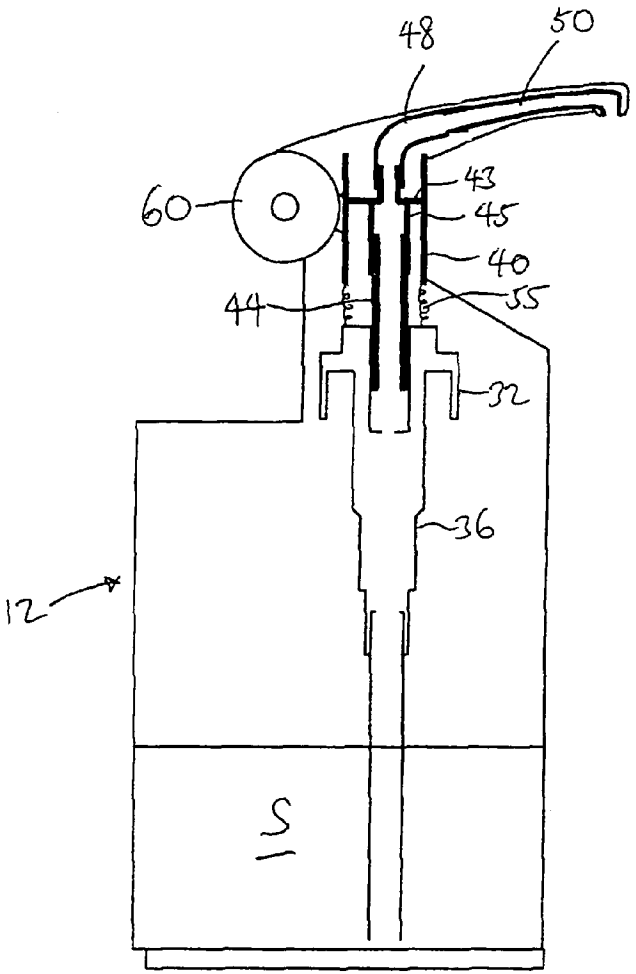
FIG. 7 is a cross-sectional view of part of the pump unit of the apparatus of FIG. 1 with the pump unit shown in the rest position.

Referring to FIGS. 7 and 8, the interior 38 of the container portion 20 is adapted to retain soap S. FIG. 7 illustrates the apparatus 10 in a rest position. When a user wishes to apply soap to his or her hands, the user presses the upper handle housing 52 adjacent the front tip thereof, which causes the upper handle housing 52 and the lower handle housing 54 to pivot downwardly in the direction of arrow A, and the support piece 40 to be pushed downwardly through the opening 41 of the pump housing 34 (see FIGS. 1 and 8). This creates the pressure needed to cause soap S from the interior 38 to be delivered via the intake tube 36, the connector tube 44, and the rubber connector 48 to the soap outlet tube 50 where the soap is dispensed through the outlet 56. A biasing member (e.g., a spring 55 in FIG. 7) can be provided in the pump housing 34 to normally bias the support piece 40 upwardly through the opening 41, which in turn causes the upper handle housing 52 and the lower handle housing 54 to pivot upwardly in the direction of arrow B (see FIG. 1) when the user releases the downward pressure on the upper handle housing 52.

The construction of the pump unit 14 allows for the user to apply a varying force to the handle housing in order to vary the amount of soap being dispensed. For example, the conventional pumps used for conventional soap dispensers require the user to press the pump downwardly to dispense soap. In contrast, the apparatus 10 dispenses soap as the user pivots the handle housing about the pivot point defined by the pivot shaft 64. By adjusting the degree of the pivot (in the direction of arrow A), the user can vary the amount of soap S that is dispensed. In addition, the pivoting motion of the handle housing means that the user can apply a lesser force to the handle housing than would otherwise be needed if the user were to exert a complete downward pushing force on a conventional pump unit.

Figure 2:
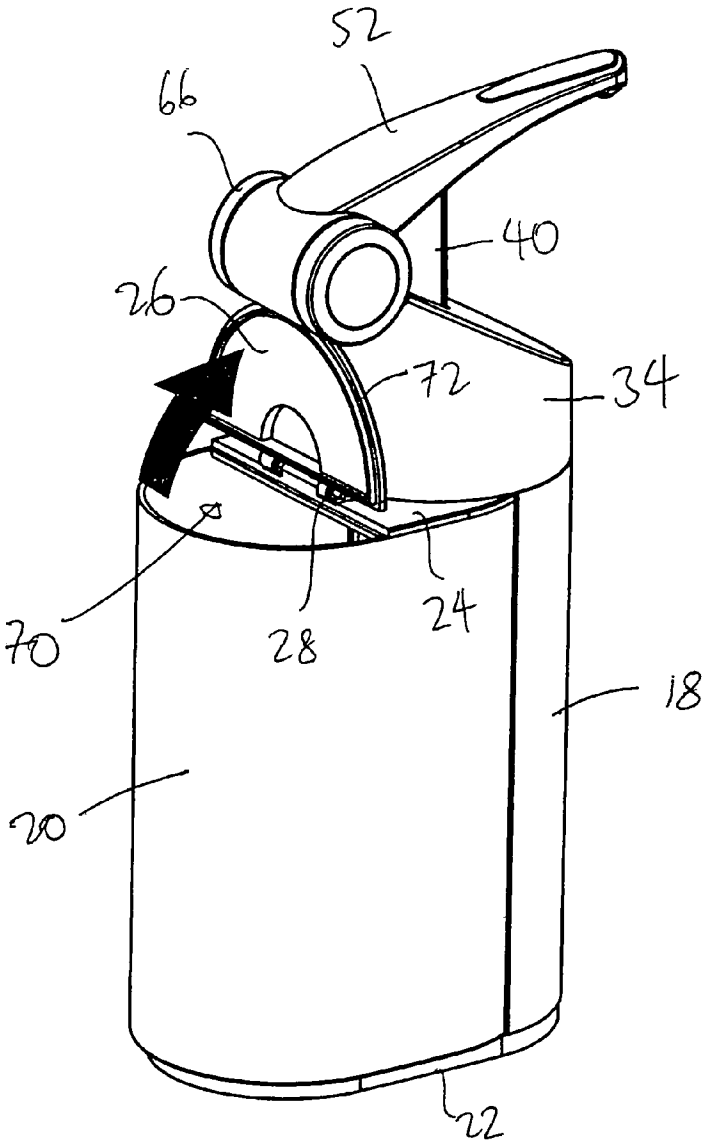
FIG. 2 is a perspective view of the apparatus of FIG. 1 shown with the lid being completely opened.
Figure 3:
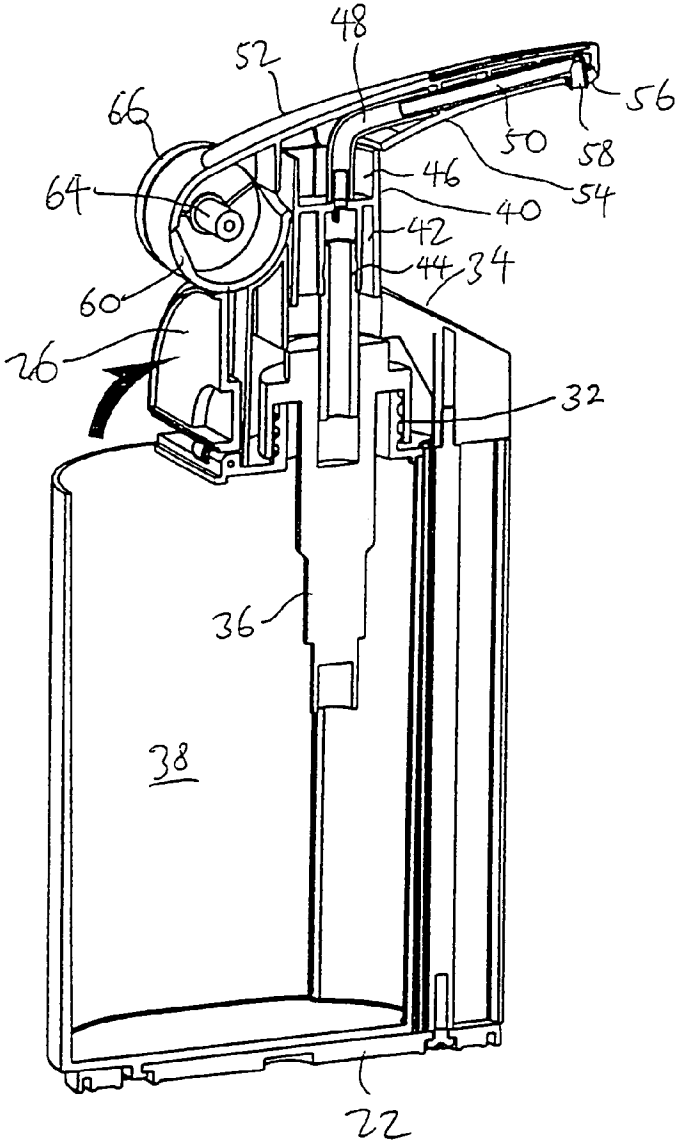
FIG. 3 is a cross-sectional view of the apparatus of FIG. 1 shown with the lid being completely opened.
Figure 4:
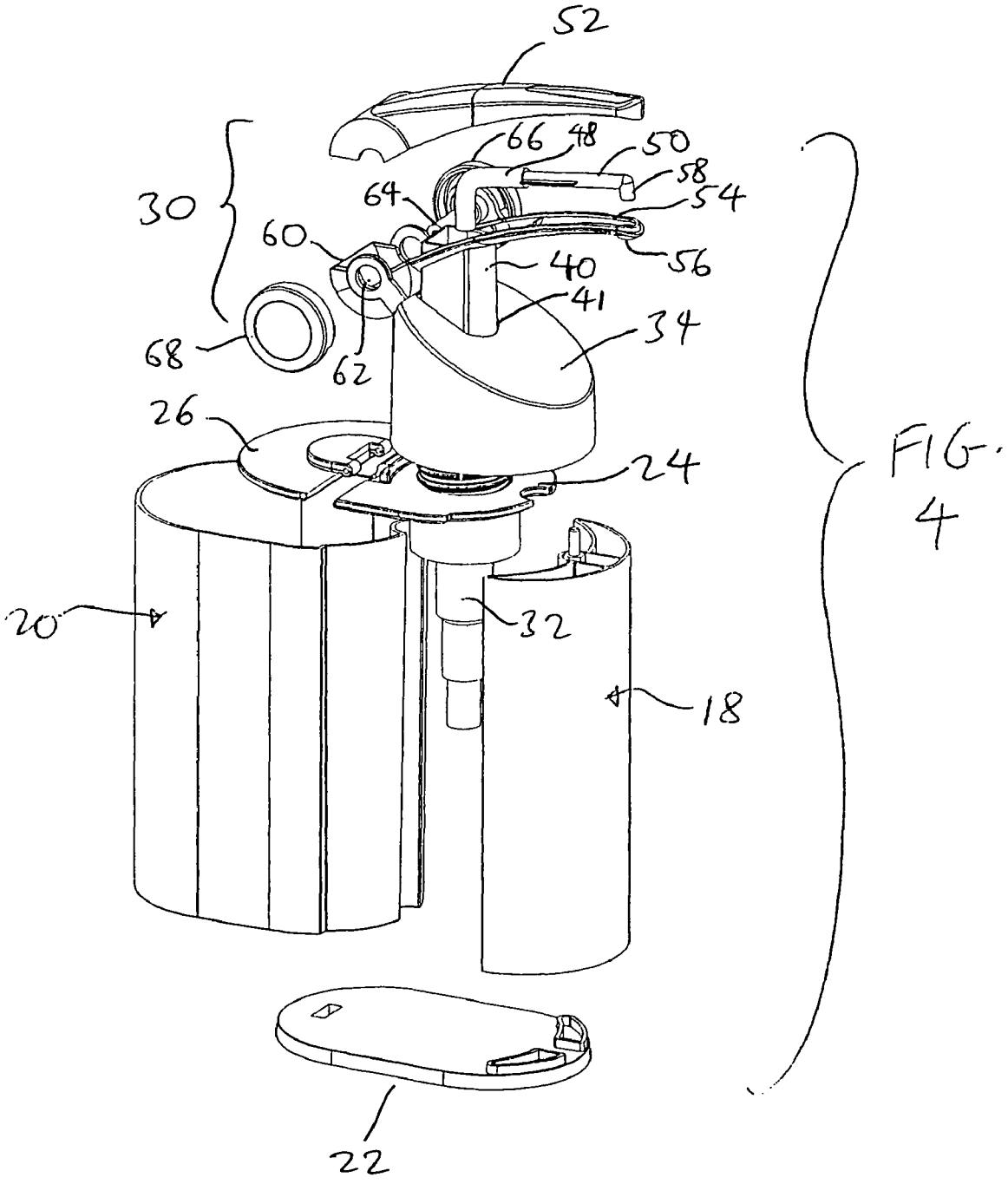
FIG. 4 is an exploded perspective view of the apparatus of FIG. 1.
Figure 6:
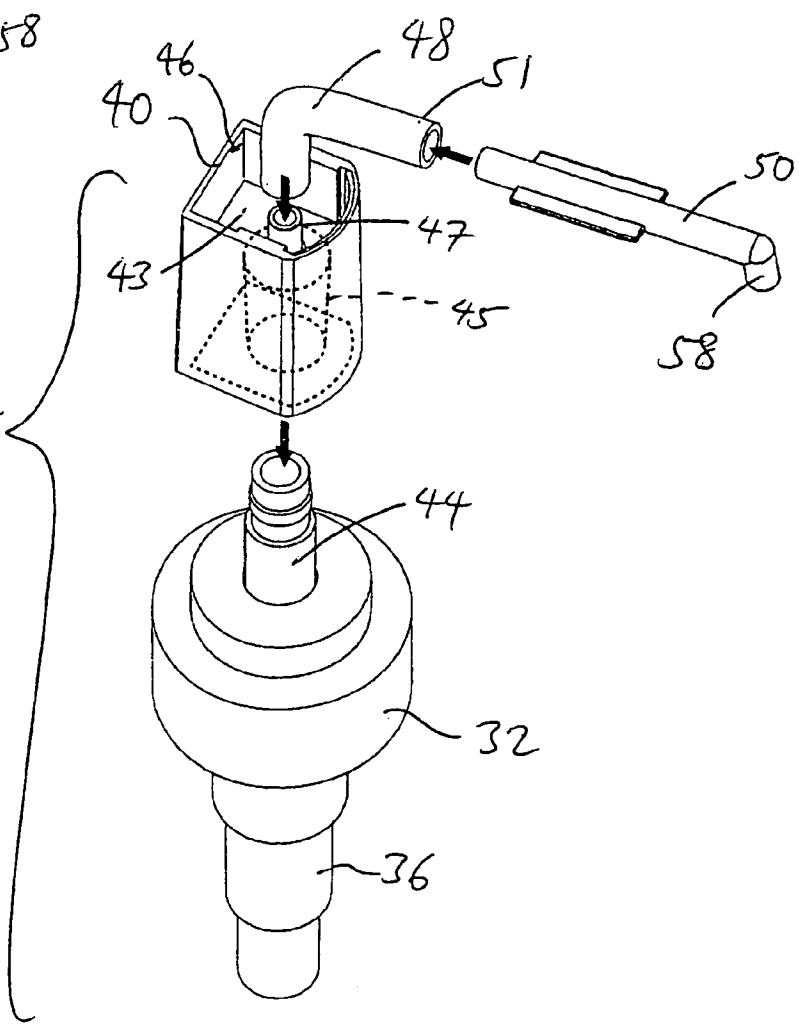
FIG. 6 is a top exploded perspective view of part of the pump unit of the apparatus of FIG. 1.
Figure 5:
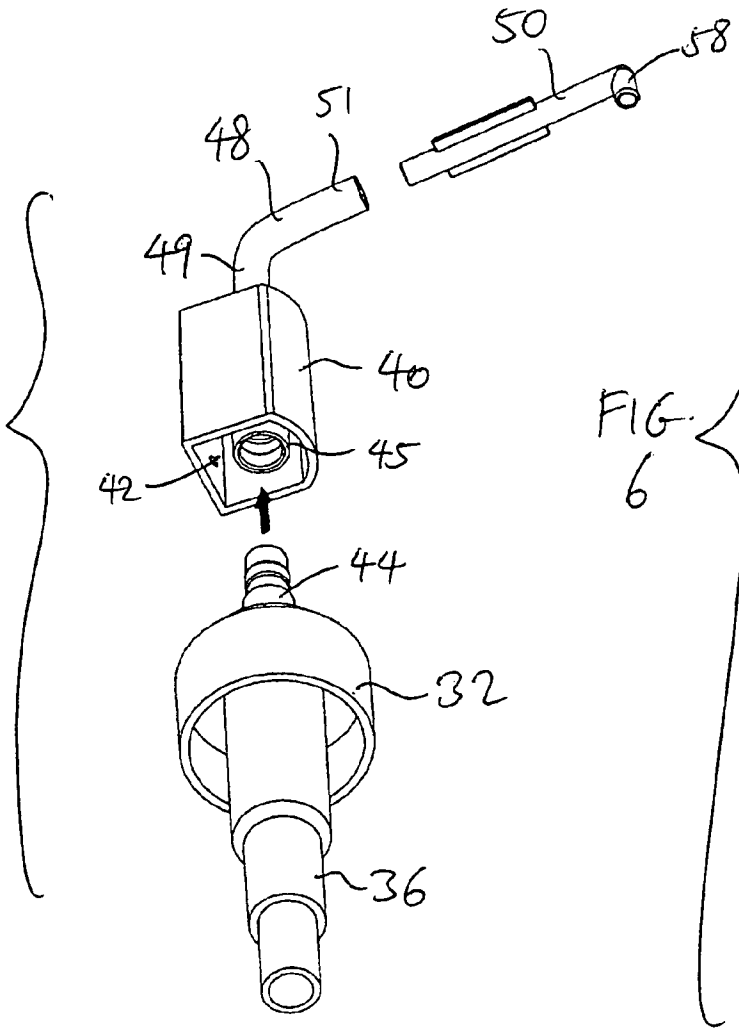
FIG. 5 is a bottom exploded perspective view of part of the pump unit of the apparatus of FIG. 1.

When the soap S inside the interior 38 has been depleted and requires replenishment, the user merely lifts up the lid 26, thereby exposing the open top 70 of the container portion 20. Soap can then be introduced through the open top 70 without the need to remove the pump unit 14 from the container housing 12. In addition, as shown in FIGS. 2 and 3, the edge 72 of the lid 26 can be retained by the pivot hinge housing 60 and the rear ends of the upper handle housing 52 and the lower handle housing 54 to maintain the lid 26 in a raised position so that the lid 26 does not hinder the introduction of soap through the open top 70. As a result, the present invention provides a soap dispensing apparatus 10 that provides an independent and dedicated opening for a quick replenishment without having to remove the pump unit 14.

Although the present invention is described as utilizing a pivoting lid, it is also possible to provide the lid 26 in the form of any lid, cover or cap that is removably connected to an opening that communicates with the interior 38. For example, the open top 70 can be embodied in the form of a threaded opening, and the lid 26 can be embodied in the form of a screw cap that is threadably coupled to the threaded opening. As another example, the lid 26 can be embodied in the form of a removable slide cover that slides above the open top 70.

Thus, the present invention provides a soap dispensing apparatus 10 where soap can be replenished in a quick, simple and clean manner without the need to remove the pump unit 14 from the container housing 12. In addition, the present invention provides an improved pump unit 14 for a soap dispensing apparatus 10 where the user can exert less force to dispense soap, while having better control over the amount of soap being dispensed.

While the description above refers to particular embodiments of the present invention, it will be understood that many modifications may be made without departing from the spirit thereof. The accompanying claims are intended to cover such modifications as would fall within the true scope and spirit of the present invention.

What is claimed is:

1. A soap dispensing device, comprising:

a housing having an interior that retains liquid soap, and an opening for depositing soap therethrough; and a pump unit connected to the housing and configured to dispense soap from the interior of the housing to the outside of the housing, wherein the pump unit comprises:

an actuator comprising an outlet about a first end and a pivot shaft about a second end, wherein the actuator is configured to pivot about the pivot shaft when a downward force is applied to the first end, and a tube in fluid connection with a lower portion of the interior of the housing and the outlet, wherein the pivoting of the actuator is configured to flow soap from the interior of the housing to the outlet via the tube; and wherein the opening is disposed separately from the pump unit.

2. The soap dispensing device of claim 1, wherein the amount of soap dispensed is proportional to the downward force applied to the first end.

3. The soap dispensing device of claim 1, wherein the amount of soap dispensed is proportional to the degree of pivoting of the actuator.

4. The soap dispensing device of claim 1, wherein the flow of soap is stopped when the downward pivoting of the actuator is stopped.

5. The soap dispensing device of claim 1, wherein the pivoting of the actuator is configured to be stopped until the actuator is substantially horizontal.

6. The soap dispensing device of claim 1, wherein the outlet is extended outwardly from the housing.

7. The soap dispensing device of claim 1, wherein at least one portion of the housing is made of translucent material.

8. The soap dispensing device of claim 1, wherein the actuator and the outlet are pivoted downwardly about the pivot shaft to draw soap from the interior of the housing to the outlet when a downward force is applied to the first end.

9. A soap dispensing device, comprising:

a housing having an interior that retains liquid soap, and an opening for depositing soap therethrough; and a pump unit connected to the housing and configured to dispense soap from the interior of the housing to the outside of the housing, wherein the pump unit comprises:

an actuator comprising an outlet about a first end and a pivot shaft about a second end, wherein the actuator is configured to pivot about the pivot shaft when a downward force is applied to the first end, and a tube in fluid connection with a lower portion of the interior of the housing and the outlet, wherein the pivoting of the actuator is configured to flow soap from the interior of the housing to the outlet via the tube; and the housing further comprising a lid, wherein the lid is configured to cover the opening.

* * * * *